US009214304B2

(12) United States Patent
Matsumoto et al.

(10) Patent No.: US 9,214,304 B2
(45) Date of Patent: Dec. 15, 2015

(54) SWITCH UNIT

(75) Inventors: Takuya Matsumoto, Suzuka (JP); Masahiko Shimada, Haga-gun (JP); Kazunaga Kasai, Utsunomiya (JP); Toru Muramatsu, Tsurugashima (JP); Masahito Kobayashi, Kawagoe (JP)

(73) Assignees: HONDA MOTOR CO., LTD., Tokyo (JP); TOYO DENSO CO., LTD., Tokyo (JP)

( * ) Notice: Subject to any disclaimer, the term of this patent is extended or adjusted under 35 U.S.C. 154(b) by 255 days.

(21) Appl. No.: 13/636,832

(22) PCT Filed: Mar. 29, 2011

(86) PCT No.: PCT/JP2011/057759

§ 371 (c)(1),
(2), (4) Date: Sep. 24, 2012

(87) PCT Pub. No.: WO2011/125639

PCT Pub. Date: Oct. 13, 2011

(65) Prior Publication Data

US 2013/0008766 A1 Jan. 10, 2013

(30) Foreign Application Priority Data

Mar. 31, 2010 (JP) ..... 2010-082019

(51) Int. Cl.
*H01H 25/04* (2006.01)

(52) U.S. Cl.
CPC ..... *H01H 25/041* (2013.01); *H01H 2025/043* (2013.01)

(58) Field of Classification Search
CPC ..... H01H 25/00; H01H 25/04; H01H 13/76
USPC ..... 200/61.54, 61.55, 61.56, 61.57, 341
See application file for complete search history.

(56) References Cited

U.S. PATENT DOCUMENTS

2011/0120849 A1* 5/2011 Morimoto et al. ..... 200/5 A

FOREIGN PATENT DOCUMENTS

| | | |
|---|---|---|
| JP | 56-114230 | 9/1981 |
| JP | 3-110733 U | 11/1991 |
| JP | 2001-351479 | 12/2001 |

(Continued)

OTHER PUBLICATIONS

European Search Report, Application No. 11765539.9, dated Aug. 7, 2013, 6 pages.

(Continued)

*Primary Examiner* — Amy Cohen Johnson
*Assistant Examiner* — Marina Fishman
(74) *Attorney, Agent, or Firm* — Rankin, Hill & Clark LLP

(57) ABSTRACT

A switch unit includes an operating component, and a base portion that supports the operating component capable of being pressed in criss-cross directions. The base portion is provided with a plurality of T-shaped regulating components that are formed in positions in directions sandwiched between the criss-cross directions. Each of the regulating components is provided with a leg portion that extends from the base portion towards the operating component, and an abutting portion that extends from an end portion of the leg portion along a line that connects together predetermined positions of the criss-cross directions that are located on both sides of each regulating component.

7 Claims, 6 Drawing Sheets

(56) References Cited

FOREIGN PATENT DOCUMENTS

| | | |
|---|---|---|
| JP | 2003-045290 | 2/2003 |
| JP | 2004-087290 | 3/2004 |
| JP | 2005-166406 A | 6/2005 |
| WO | 2009/116206 A1 | 9/2009 |

OTHER PUBLICATIONS

JP Notice of Allowance with English Translation, Application No. 2012-509478, dated May 14, 2013, 6 pages.

* cited by examiner

SWITCH UNIT

BACKGROUND OF THE INVENTION

1. Field of the Invention

This invention relates to a switch unit.

Priority is claimed on Japanese Patent Application No. 2010-082019, filed Mar. 31, 2010, the contents of which are incorporated herein by reference.

2. Description of the Related Art

Among switch units, switch units are known that are able to make inputs in multiple directions by performing an oscillating operation in which the key top is moved in the four directions of a cross, and a pressing operation in which a central portion of the key top is pressed.

This switch unit is provided with leg portions that extend downwards from rear-side flange portions that are located in portions that are sandwiched between criss-cross directions, which form the key top operating directions. When the key top is moved in one of the criss-cross directions, the relevant leg portion is pressed against a substrate so as to prevent the oscillating motion being greater than is necessary, and so as to prevent the center portion of the key top being pressed in error when it is moved in one of the criss-cross directions (see, Japanese Patent No. 3993404 (Patent document 1)).

However, in the above-described conventional switch unit, there is no problem if the key top is moved in one of the criss-cross directions, however, if the key top is moved in one of the directions sandwiched between the criss-cross directions, which is not one of the directions where it is assumed that an input operation using the key top will be made, then the above-described structure causes a leg portion to come into point contact with the substrate. Accordingly, if the direction of the load acting on this leg portion is then shifted from this point contact, in some cases, the key top swings in the opposite direction from the intended direction around the contact point. Because of this, it is necessary to pay careful attention to the operation, and the operability of the switch unit is poor.

SUMMARY OF THE INVENTION

The present invention provides a switch unit that enables an operation in criss-cross directions to be made both easily and reliably, and that has superior operability.

In order to achieve the above-described object, the switch unit according to an aspect of the present invention includes: an operating component; a base portion that supports the operating component capable of being pressed in criss-cross directions, the base portion is provided with a plurality of T-shaped regulating components that are formed in positions in directions sandwiched between the criss-cross directions, and each of the regulating components is provided with a leg portion that extends from the base portion towards the operating component, and an abutting portion that extends from an end portion of the leg portion along a line that connects together predetermined positions of the criss-cross directions that are located on both sides of each regulating component.

In this switch unit, it is also possible for the leg portions are formed by elastically deformable components, and, the thickness of the leg portions in a direction which is orthogonal to a direction sandwiched between the criss-cross directions is smaller than a thickness of the leg portions in one of the directions sandwiched between the criss-cross directions.

In this switch unit, it is also possible for switches that are capable of being pressed via the operating component to be located in predetermined positions in the criss-cross directions on the base portion, and for the operating component to be provided with switch abutting portions that are capable of pressing the switches, and that are formed on a flange portion which forms a circumferential edge portion of a rear surface of the operating component, and for regulating component abutting portions that abut against the abutting portions of the regulating components to be formed further on the inner side in the radial direction of the operating component than the switch abutting portions.

In this switch unit, when the operating component is pressed in one of the directions sandwiched between the criss-cross directions, it is also possible for the regulating components to abut against the operating component and regulate the pressing operation of the operating component.

According to an aspect of the present invention, regulating components are placed in positions in each of the directions that are sandwiched between the criss-cross directions, and are formed in T-shapes and are positioned facing each other. Accordingly, when the operating component is pressed in one of the directions sandwiched between the criss-cross directions where the switch cannot be pressed, the movement of the operating component in that direction is obstructed, and a suitable sense that the operation is not proper is imparted to the operator. Furthermore, because it is possible to prevent an unintentional operation in one of the directions sandwiched between the criss-cross directions, the operating component can be moved simply and reliably in one of the criss-cross directions.

According to an aspect of the present invention, the reaction force from the regulating component that is received when the operating component is pressed in one of the directions sandwiched between the criss-cross directions is greater than the reaction force from the regulating component that is received when the operating component is pressed in one of the criss-cross directions. Accordingly, if the operating component is operated in a direction that matches one of the directions sandwiched between the criss-cross directions, it is possible to prevent the operating component being tilted over more than is necessary, and it is possible to prevent the switch being subsequently pressed so as to move in one of the criss-cross directions.

According to an aspect of the present invention, when the operating component is operated in one of the criss-cross directions at the same time as the pressing of the operating component so that it is operated in one of the directions sandwiched between the criss-cross directions is suitably prevented, then compared with when the regulating component abutting portion of the regulating component is located on the outer side in a radial direction of the switch abutting portion, the reaction force that the operating component receives from the regulating component can be reduced, and it is possible to suppress any obstruction from the regulating component when the operating component is being pressed in one of the criss-cross directions.

DETAILED DESCRIPTION OF THE PREFERRED EMBODIMENTS

Next, embodiments of this invention will be described based on the drawings.

Figure 1:
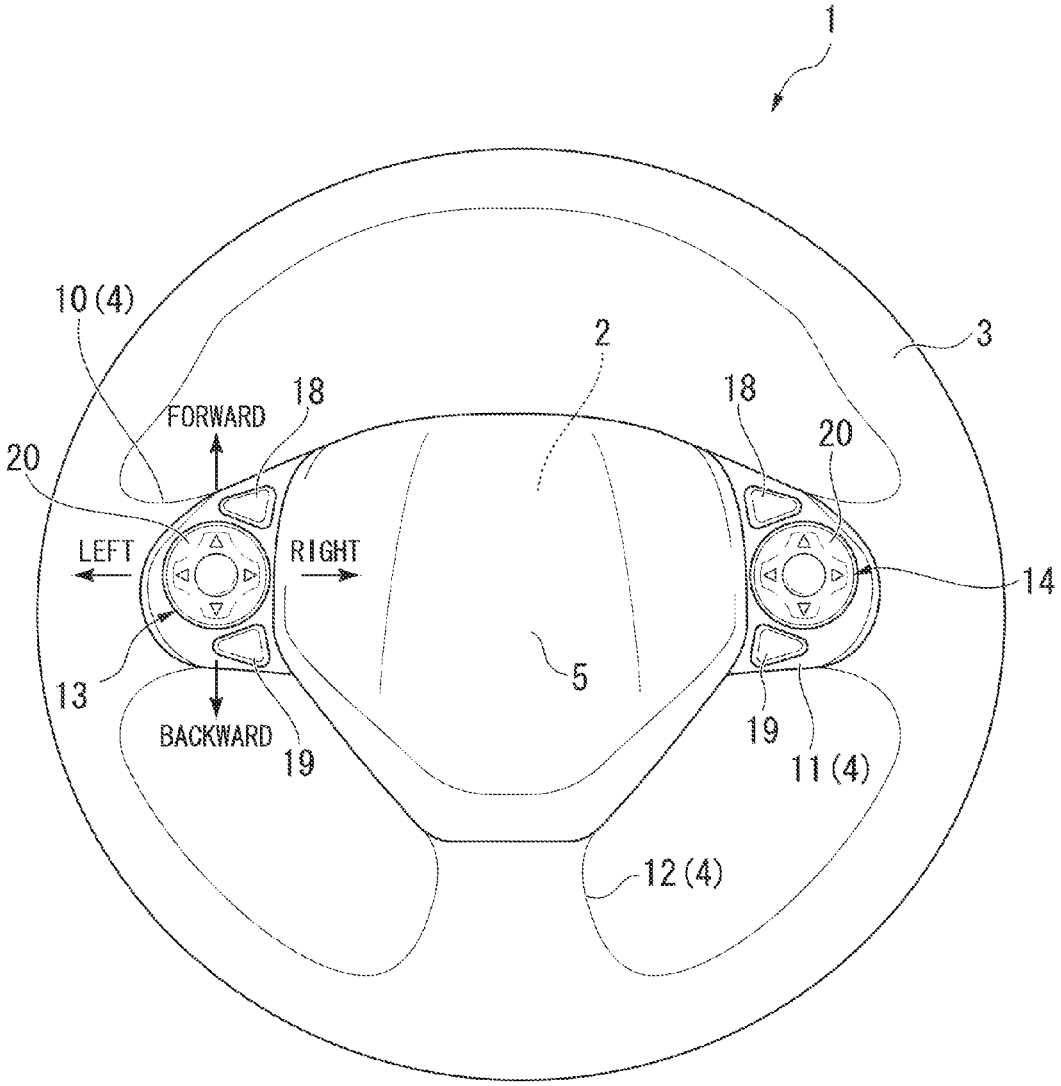
FIG. 1 is a front view of a steering wheel that is provided with a switch unit according to an embodiment of the present invention.

As shown in FIG. 1, a steering wheel 1 of a vehicle such as an automobile is provided with a boss portion 2 that is fixed to a steering shaft (not shown), a toroidal rim portion 3 that is gripped by a driver, and by spoke portions 4 that join the rim portion 3 to the boss portion 2. An air bag unit (not shown) is mounted inside the boss portion 2. In addition to this, a horn switch 5 is provided on a top surface of the boss portion 2.

The spoke portions 4 are provided with a left-side (i.e., a first) spoke portion 10 which, when the steering wheel 1 is in a neutral position, extends to the left side, a right-side (i.e., a second) spoke portion 11 which extends to the right side, and a down-side (i.e., a third) spoke portion 12 which extends downwards. A left-side (i.e., a first) switch unit 13 and a right-side (i.e., a second) switch unit 14 are provided respectively on the left-side spoke portion 10 and the right-side spoke portion 11.

Here, the left-side switch unit 13 is a switch unit for information systems such as audio and car navigation systems and the like. The right-side switch unit 14 is a switch unit for running systems such as auto cruise and the like. The switch units 13 and 14 are placed in positions where they can be operated by the thumb of a driver who is holding the steering wheel 1.

Figure 2:
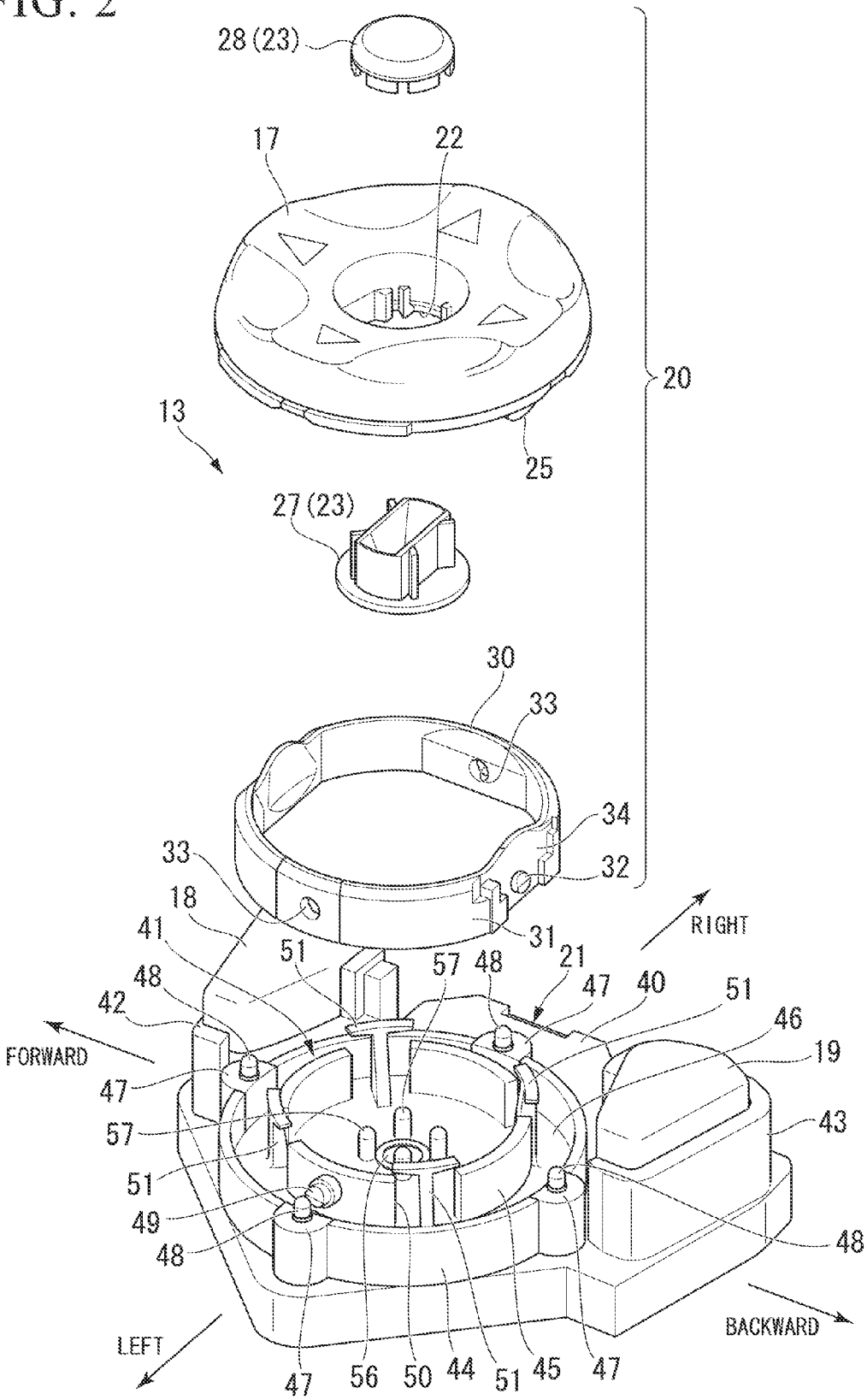
FIG. 2 is an exploded perspective view of a switch unit.
Figure 3:
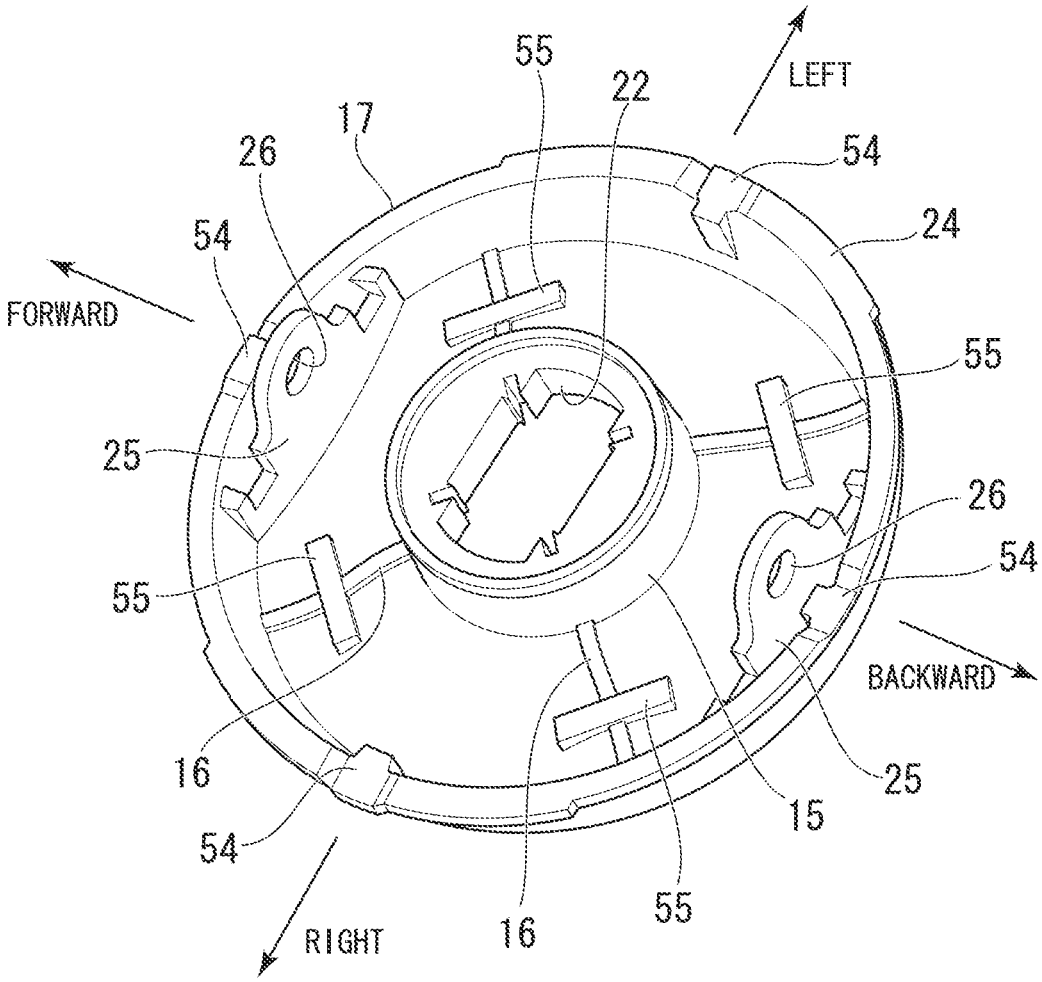
FIG. 3 is a perspective view of an operating component as seen from the rear side thereof.

As shown in FIGS. 2 and 3, the switch unit 13 is provided with an operating component 20 that is formed by a simple resin component in a circular shape when viewed from front-on, and a base portion 21 that supports the operating component 20 capable of being be pressed in the left-right directions and front-rear directions that form the criss-cross directions. When the switch unit 13 is mounted on the steering wheel 1, operating buttons 18 and 19 are provided on the base portion 21 at the front and rear respectively of the operating component 20. Here, the criss-cross directions that form the operating directions of the operating component 20 are the left-right directions, and front-rear directions shown by arrows in FIGS. 1 and 2.

The switch unit 13 is a switch that is used to select and decide items based on display information on the display portion of a multi-information display that is provided in a meter panel (not shown). The front side (i.e., the top side in FIG. 1, namely, the first) operating button 18 is a switching button that is used to switch between various items, namely, between a fuel consumption display, an audio display, an odometer display, and a trip meter display based on the display information of the display portion of the multi-information display. The rear side (i.e., the bottom side in FIG. 1, namely, the second) operating button 19 is a menu display button that is used to set the background and the clock of the display portion. The operating component 20 performs various operations for items that are selected and activated by the operating buttons 18 and 19.

Because both the left-side switch unit 13 and the right-side switch unit 14 have the same structure, the following description uses the left-side switch 13 as an example.

The operating component 20 is provided with an operating component main body 17 in whose central portion there is provided an aperture portion 22, a press button 23 that is provided in the aperture portion 22 and is able to be pressed, and an oscillating ring 30 that is interposed between the operating component main body 17 and the base portion 21. The shape of the operating component main body 17 is formed such that the surface thereof slopes gradually downwards moving from the circumferential edge portion towards the center portion thereof. A flange portion 24, which faces downwards in FIG. 2, is formed on a circumferential edge on the rear side of the operating component main body 17.

A pair of supporting pieces 25, which face downwards in FIG. 2, are formed facing in one of the criss-cross directions (i.e., in either a first direction, or a second direction that orthogonally intersects the first direction), and more specifically, are formed facing in the front-rear direction on an inner side of the flange portion 24. As shown in FIG. 3, a hole 26 is provided in each of these supporting pieces 25.

As shown in FIG. 3, a central boss portion 15, in which the aperture portion 22 is formed, is formed in a circular column shape on the rear side of the operating component main body 17. Ribs 16 that extend in directions sandwiched between the criss-cross directions (i.e., in directions that are inclined relative to the first direction and second direction), and that extend as far as the flange portion 24 are formed on the outside of the central boss portion 15.

The press button 23, which is inserted into the aperture portion 22 of the operating component main body 17 such that it is able to be pressed, is provided with a pressing body 27 that presses a central switch 57 (described below), and with a button cover 28 that is fitted onto a top portion of the pressing body 27.

The reference numeral 30 shows the cylindrical oscillating ring. The oscillating ring 30 supports the operating component main body 17 such that the operating component main body 17 is able to oscillate in a left-right direction taking as its axis the front-rear direction. In addition to this, the oscillating ring 30 is supported on the base portion 21 such that the oscillating ring 30 is able to oscillate in the front-rear direction taking as its axis the left-right direction. Shaft portions 32 are provided on both surfaces of an outer circumferential wall 31 of the oscillating ring 30 that face in the front and rear directions (i.e., on the outer circumferential surfaces of the oscillating ring 30 in the front and rear directions). These shaft portions 32 are inserted in the front-rear direction from the inside of the supporting pieces 25 towards the outside thereof into the holes 26 in the supporting pieces 25 of the operating component main body 17. These shaft portions 32 support the operating component main body 17 such that it is able to oscillate in the left and right directions. Recessed portions 34 that receive from the outside the supporting pieces 25 of the operating component main body 17 around the shaft potions 32, and that permit rotational movement of the supporting pieces 25 are formed in the outer circumferential wall 31 of the oscillating ring 30.

Supporting holes 33 through which are inserted supporting pins 49 of the base portion 21 are formed in surfaces of the outer circumferential wall 31 of the oscillating ring 30 that face in the left and right directions (i.e., the outside surfaces thereof in the left and right directions). These supporting holes 33 support the oscillating ring 30 such that, taking the left-right direction as an axis, it is able to oscillate in the front-rear directions around the supporting pins 49 on the outside of an inside wall portion 45 of the base portion 21. By interposing this oscillating ring 30, the operating component 20 is supported such that it is able to oscillate in the front-rear directions and the left-right directions, namely, in the criss-cross directions relative to the base portion 21.

The base portion 21 is installed inside the left-side spoke portion 10. A top wall 40 of the base portion 21 is provided with a mounting portion 41 for the operating component 20 that is formed in a center portion in the front-rear direction of the top wall 40. The top wall 40 is provided with holder portions 42 and 43 that respectively support the operating buttons 18 and 19 such that these are able to be pressed. The holder portions 42 and 43 are formed at the front and rear of the mounting portion 41.

The mounting portion 41 is provided with a cylindrical outside wall portion (i.e., a first wall portion) 44, and a cylindrical inside wall portion (i.e., a second wall portion) 45, and the outside wall portion 44 and inside wall portion 45 form a double layer around the same central core.

A toroidal housing portion 46 for housing the oscillating ring 30 is formed between the outside wall portion 44 and the inside wall portion 45. The outside wall portion 44 is formed in a position that matches the position of the flange portion 24 of the operating component main body 17, while the inside wall portion 45 receives the central boss portion 15 of the operating component main body 17.

The top portion of the outside wall portion 44 is provided with four boss portions 47 in the criss-cross directions, and an operating switch 48 that is able to be pressed as a result of the operating component 20 being operated in one of the criss-cross directions is provided in each boss portion 47.

The supporting pins 49 that protrude outwards in the left and right directions are provided on the outer wall surfaces of the inside wall portion 45. These supporting pins 49 are inserted into the supporting holes 33 in the oscillating ring 30, and support the oscillating ring 30 such that it is able to oscillate in the front and rear directions.

Figure 4:
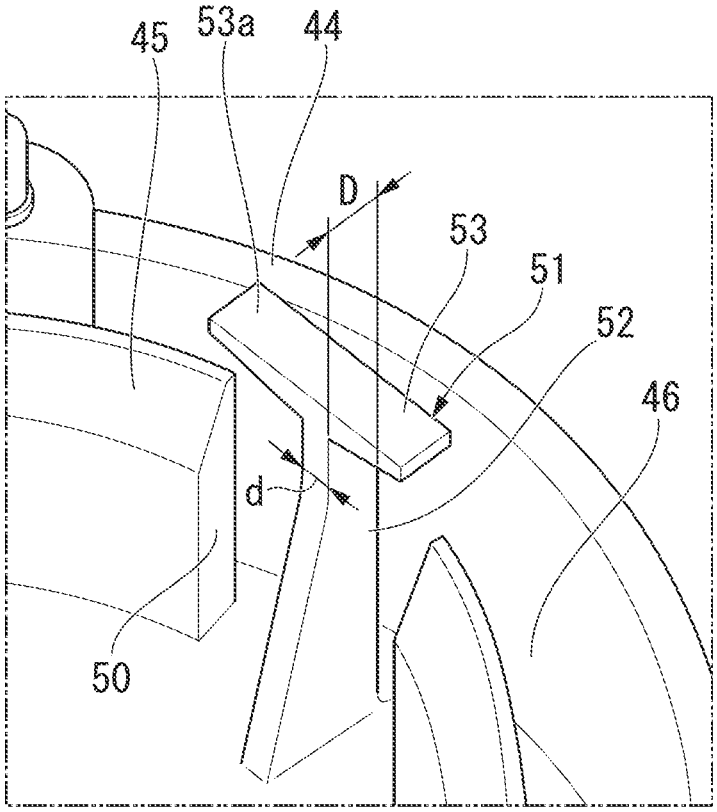
FIG. 4 is an enlarged view of principal portions of FIG. 2.

As also shown in FIG. 4, notch portions 50 are evenly distributed in four locations in the inside wall portion 45 at positions that correspond to the directions sandwiched between the criss-cross directions. Regulating components 51 that are formed in a T-shape are provided standing vertically upright in these notch portions 50. When the operating component 20 is oscillated in one of the directions sandwiched between the criss-cross directions, the corresponding regulating component 51 comes into contact with the rear surface of the operating component main body 17 of the operating component 20 (i.e., with a regulating component abutting portion 55 (described below)), and stably supports this rear surface. As a result, even if the operating component 20 is pressed even further onto that side, it is possible to regulate the dropping onto one of the criss-cross directions by the operating component 20.

The regulating components 51 are formed in a T-shape that is made up of a leg portion 52 that extends from the top wall 40 of the base portion 21 towards the operating component 20, and an abutting portion 53 that extends from an end portion of the leg portion 52. The abutting portions 53 extend in a straight line towards the sides from the end portion of the leg portion 52 along a line that connects together the other regulating components 51 and 51 that are positioned on the two sides of a regulating component 51. In this embodiment, a structure is described in which the abutting portions 53 are provided extending in a straight line towards the sides from the end portion of the leg portion 52 along a line connecting the regulating components 51 and 51 together. However, the present invention is not limited solely to this, and there are no particular restrictions provided that the abutting portions 53 connect together predetermined positions in criss-cross directions. Because they may also connect these positions together in a curved line, the abutting portions may also be formed a shape that extends in a curved line.

The leg portions 52 are formed integrally with the base portion 21 such that they are able to be elastically deformed. If the thickness of the leg portions 52 in the directions sandwiched between the criss-cross directions, which are the operating directions of the operating component 20, is taken as D, then a thickness d of the leg portions 52 in orthogonal directions relative to these directions is smaller than D (i.e., d D). In other words, the thickness D of the leg portions 52 in the radial direction of the inside wall portion 45 is larger than the thickness d of the leg portions 52 in the circumferential direction of the inside wall portion 45.

Figure 5A:
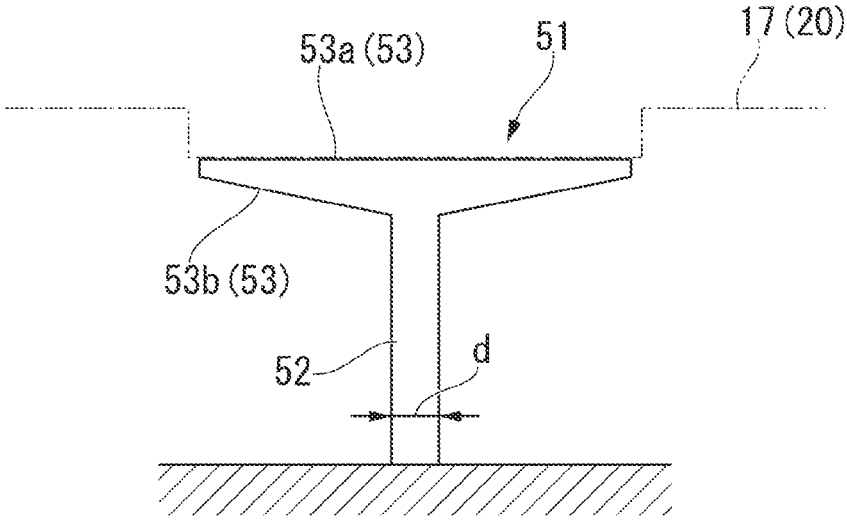
FIG. 5A is a front view of a regulating component showing a state of the regulating component when an operating component is pressed in a direction sandwiched between the criss-cross directions.
Figure 5B:
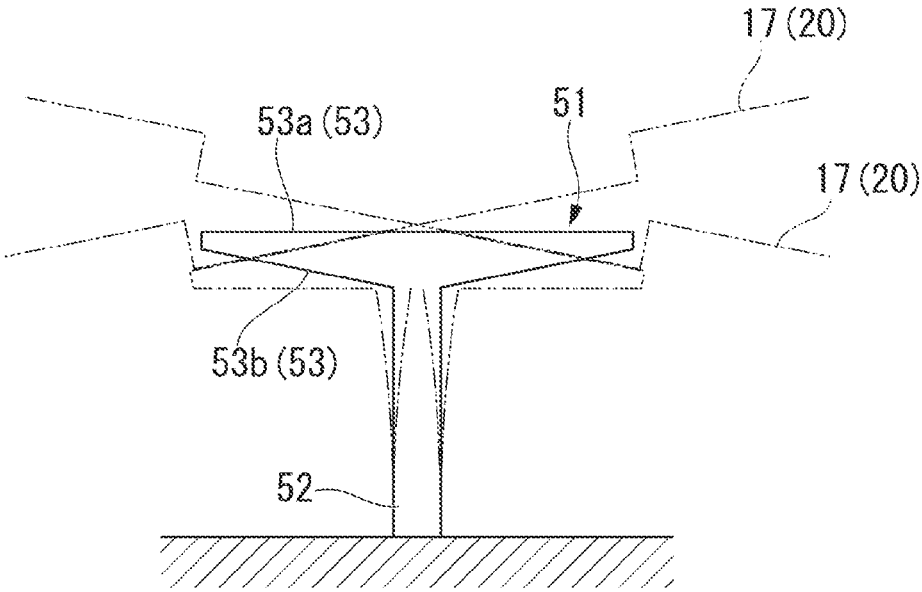
FIG. 5B is a front view of a regulating component showing a state of the regulating component when an operating component is pressed in a criss-cross directions.
Figure 6:
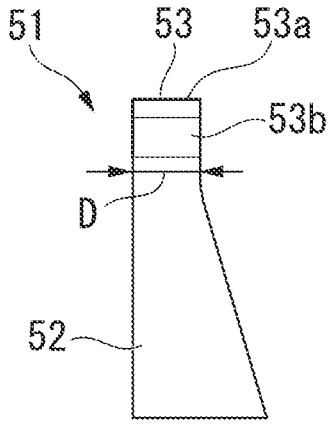
FIG. 6 is a side view of a regulating component.

Specifically, as shown in FIGS. 5A and 5B, and in FIG. 6, the thickness D in a direction following criss-cross directions of the join portion of the abutting portions 53 changes so as to become gradually larger on the inner side of the operating component 20 as it moves downwards. In contrast to this, the thickness d of the leg portions 52 extending in a direction that is parallel to an orthogonal direction relative to criss-cross directions has a fixed width in a vertical direction, and is set so as to be smaller than the aforementioned thickness D of the join portion of the abutting portions 53. FIG. 5A shows a state of the regulating component 51 when the operating component 20 is pressed in one of the directions sandwiched between the criss-cross directions. FIG. 5B shows a state of the regulating component 51 when the operating component 20 is pressed in one of the criss-cross directions.

The height of the abutting portions 53 of the regulating components 51 is slightly higher than the height of the inside wall portion 45, and top surfaces 53*a* of the abutting portions 53 are formed horizontally flat and with the same thickness (i.e., the width when they are viewed from above) extending in a straight line. Bottom surfaces 53B are formed having a sloping shape such that the thickness of the abutting portions 53 becomes gradually thinner moving from the leg portion 52 towards the distal end thereof. Accordingly, the thickness of the abutting portions 53 in the vertical direction becomes gradually smaller moving towards the distal end sides of the abutting portions 53.

A light guide-hole 56 is formed in a center portion inside the inside wall portion 45. This light guide-hole 56 guides light upwards from a lamp which is provided inside the base portion 21. The central switches 57 that are pressed by the pressing button 23 are provided in four locations around the light guide-hole 56.

As shown in FIG. 3, the flange portion 24 which is provided on a circumferential edge portion of the rear surface of the operating component main body 17 is provided in a position that matches the outside wall portion 44 of the base portion 21. The operating switches 48 are provided in each one of the four boss portions 47 that are formed on the top portion of the outside wall portion 44. In four locations on the flange portion 24 there are provided switch contact portions 54 that are able to press the respective operating switches provided in the boss portions 47. Regulating component abutting portions 55 are provided extending orthogonally to the placement positions of the ribs 16 on the inner side in the radial direction from the switch contact portions 54 on the rear surface of the operating component main body 17. The regulating component abutting portions 55 abut against the abutting portions 53 of the regulating component 51 when the operating component 20 is operated in one of the directions sandwiched between the criss-cross directions.

Here, as shown in FIG. 5A, in a state in which the operating component 20 is pressed in one of the directions sandwiched between the criss-cross directions, and the top surface 53*a* of the abutting portion 53 of a regulating component 51 is pressed against a regulating component abutting portion 55, then even if the user attempts to further press the operating component 20 in one of the criss-cross directions from that state, because the user is trying to tilt the regulating component 51 while the entire abutting portion 53 of the regulating component 51 is abutting against the regulating component abutting portion 55, the regulating component 51 is not able to actually become tilted, and neither is the operating component 20 able to be tilted in one of the criss-cross directions from the state shown in FIG. 5A and be operated mistakenly.

In contrast, as shown by the chain line in FIG. 5B, when the operating component 20 is operated in one of the criss-cross directions, the regulating component abutting portion 55 of the operating component main body 17 interferes so as to bend a portion of the vicinity of the distal end portion of the abutting portion 53 so that it becomes tilted downwards. However, in the regulating component 51, due to the tilting deformation of the leg portion 52 which has the thickness d, and due also to the bending deformation of the distal end of the abutting portion 53, the regulating component 51 does not obstruct the movement of the operating component 20 in the particular criss-cross directions.

According to the above described embodiment, the T-shaped regulating components 51 are placed on the base portion 21 in positions where they are sandwiched between the criss-cross directions, namely, between the operating directions of the operating component 20, and are formed opposite each other. Accordingly, if the operating component 20 is pressed in one of the directions that is sandwiched between the criss-cross directions and where it is not possible for any of the operating switches 48 to be pressed, as shown by the chain line in FIG. 5A, the regulating component abutting portion 55 of the operating component main body 17 abuts against the top surface 53*a* of the abutting portion 53 of the regulating component 51 so that the operating component 20 is blocked from any further movement in one of the criss-cross directions, and a suitable feeling that something is not right is imparted to the user, namely, the user is made to feel that even if they continue to press the operating component 20, they will still not be able to turn on the operating switch 48.

Accordingly, as a result of the regulating component abutting portion 55 of the operating component main body 17 being stably supported against the abutting portion 53 of the regulating component 51, even if the operating component 20 is pressed even further onto one side, it is possible to prevent the operating component 20 from dropping into one of the criss-cross directions, and to prevent the particular operating switch 48 located in that particular criss-cross directions from being pressed in error, so that any unintended operation can be prevented. As a result, the movement by the operating component 20 in one of the criss-cross directions can be achieved easily and reliably.

Accordingly, if, for example, the operating component 20 is selected to perform an audio operation, with operations in the forwards and backwards directions respectively raising and lowering the volume, and operations in the left and right directions respectively selecting the radio station and the selecting the song on the CD player, then if a user who actually intended to move the operating component 20 towards the front in order to turn up the volume of the radio mistakenly presses the operating component 20 in a diagonal direction towards the front and right, hitherto, this would have caused an erroneous operation such as the unforeseen selection of a radio station or CD song. However, according to the present embodiment, at the point when the mistaken operation in a diagonal direction towards the front and right occurred, the regulating component abutting portion 55 of the operating component 20 is supported by the regulating component 51 so that, not only is the operating component 20 prevented from dropping into the wrong position, but the user is made to realize their mistaken operation by being made to feel that something is wrong. As a consequence, they are encouraged to operate the operating component 20 once again in the proper forwards direction.

In contrast, when the operating component 20 is operated in one of the criss-cross directions, the two end portions of the regulating component abutting portion 55 of the operating component main body 17 do interfere with portions of the abutting portions 53 of the regulating component 51. However, because the shapes of the two end portions of the abutting portions 53 are formed such that their thickness becomes gradually smaller so that it is easy for the leg portion 25 to be tilted over, the load from the operation can be dispersed by the flexure of the abutting portion 53 and the leg portion 52, so that any concentration of stress can be prevented. As a result, the regulating components 51 have no effect on the movement of the operating component 20 in one of the criss-cross directions. Accordingly, an operation to move the operating component 20 in the forwards or backwards direction in order to raise or lower the volume, and an operation to move the operating component 20 in the left or right directions in order to select a radio station or select a song on the CD player can be performed both easily and reliably.

In other words, the thickness of the distal end sides of the abutting portion 53 of the regulating component 51 is made thinner, and compared to the thickness D of the leg portions 52 of the regulating components 53 in a direction which is parallel to a criss-cross directions, the thickness d of the leg portions 52 in a direction which is orthogonal to that parallel direction is smaller. Accordingly, compared to the reaction force from the regulating component 51 that is received by the operating component main body 17 of the operating component 20 when the operating component 20 is pressed in one of the criss-cross directions, the reaction force from the regulating component 51 that is received when the operating component 20 is pressed in one of the directions sandwiched between the criss-cross directions is greater. Because of this, when the operating component 20 is operated in a direction that is parallel to a direction sandwiched between the criss-cross directions, it is possible to prevent the operating component 20 being tilted over more than is necessary. Moreover, it is also possible to prevent the operating component 20 from dropping from that state into any one of the criss-cross directions, and to prevent the operating switch 48 located in that particular criss-cross directions from being pressed in error.

Moreover, if, while a pressing operation to move the operating component 20 in one of the directions sandwiched between the criss-cross directions is being suitably prevented, the operating component 20 is operated in one of the criss-cross directions, because the regulating component abutting portion 55 is located on the inside in a radial direction of the switch abutting portion 54, then compared to when the regulating component abutting portion 55 is located on the outside in a radial direction of the switch abutting portion 54, the reaction force that the operating component 20 receives from the regulating component 51 is reduced, and it is possible to limit the blocking effect from the regulating component 51 when an operation to press the operating component 20 in one of the criss-cross directions is being performed.

The present invention is not limited solely to the above described embodiment. For example, the shape of the abutting portion 53 of the regulating components 51 is formed such that the top surface 53*a* of the abutting portion 53 extends in a straight line, while the bottom surface 53*b* is formed having a sloping shape such that the thickness of the abutting portion 53 becomes gradually thinner moving from the leg portion 52 towards the distal end thereof. However, it is also possible to form the top surface 53*a* side such that the thickness of the abutting portion 53 becomes gradually thinner towards the distal end thereof. Moreover, provided that the leg portions 52 are elastically deformable, they may also be formed from a rubber material or the like as separate components from the base portion 21. In addition, a case in which the left-side switch unit 13 is a switch unit for information systems such as audio and car navigation systems and the like, while the right-side switch unit 14 is a switch unit for running systems such as auto cruise and the like has been described above, however, the present invention is not limited to this. In the above-described embodiment, an example of a switch unit that is mounted in the steering wheel of a vehicle such as an automobile has been described. However, the switch unit according to the above-described embodiment is not solely limited to being used in vehicles, and may also be used, for example, in gaming machines and devices that perform criss-cross directions operations.

The switch unit according to the invention of the present application can be widely used in various devices and components and the like that perform criss-cross directions operations.

What is claimed is:

1. A switch unit comprising:

an operating component;

a base portion that supports the operating component capable of being pressed in criss-cross directions by a user, the base portion being provided with a plurality of T-shaped regulating components that are formed in positions in directions sandwiched between the criss-cross directions, each of the regulating components being provided with a leg portion that extends from the base portion towards the operating component, and an abutting portion that extends from an end portion of the leg portion along a line that connects together predetermined positions of the criss-cross directions that are located on both sides of each regulating component, wherein the regulating components are adapted to regulate a pressing operation of the operating component by the user when the operating component is pressed in one of the directions sandwiched between the criss-cross directions by contacting a rear surface of the operating component, the leg portion is formed by elastically deformable components, and a thickness of the leg portion in a direction sandwiched between the criss-cross directions, which is one of said directions sandwiched between the criss-cross directions in which the regulating component including the leg portion is positioned, is larger than a thickness of the leg portion in a direction which is orthogonal, along a plane of an upper surface of the base portion from which the leg portion extends, to said direction sandwiched between the criss-cross directions.

2. The switch unit according to claim 1, further comprising switches capable of being pressed via the operating component, located in predetermined positions in the criss-cross directions on the base portion, wherein the operating component is provided with switch abutting portions that are capable of pressing the switches, and that are formed on a flange portion which forms a circumferential edge portion of the rear surface of the operating component, and regulating component abutting portions that abut against the abutting portions of the regulating components are formed further on the inner side in the radial direction of the operating component than the switch abutting portions.

3. The switch unit according to claim 1, wherein, when the operating component is pressed in one of the directions sandwiched between the criss-cross directions, the regulating components abut against the operating component and regulate the pressing operation of the operating component.

4. The switch unit according to claim 1, further comprising switches capable of being pressed via the operating component, located in predetermined positions in the criss-cross directions on the base portion, wherein the operating component is provided with switch abutting portions that are capable of pressing the switches, and that are formed on a flange portion which forms a circumferential edge portion of the rear surface of the operating component, and regulating component abutting portions that abut against the abutting portions of the regulating components are formed further on the inner side in the radial direction of the operating component than the switch abutting portions.

5. The switch unit according to claim 1, wherein, when the operating component is pressed in one of the directions sandwiched between the criss-cross directions, the regulating components abut against the operating component and regulate the pressing operation of the operating component.

6. The switch unit according to claim 2, wherein, when the operating component is pressed in one of the directions sandwiched between the criss-cross directions, the regulating components abut against the operating component and regulate the pressing operation of the operating component.

7. The switch unit according to claim 4, wherein, when the operating component is pressed in one of the directions sandwiched between the criss-cross directions, the regulating components abut against the operating component and regulate the pressing operation of the operating component.

* * * * *